US010618312B2

(12) United States Patent
Nishimura et al.

(10) Patent No.: US 10,618,312 B2
(45) Date of Patent: Apr. 14, 2020

(54) THERMAL PRINTER, CONTROL METHOD OF A THERMAL PRINTER, AND PRINTING SYSTEM

(71) Applicant: SEIKO EPSON CORPORATION, Tokyo (JP)

(72) Inventors: Hideki Nishimura, Matsumoto (JP); Toshihiro Hagiwara, Matsumoto (JP); Yuki Nishimoto, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/185,992

(22) Filed: Nov. 9, 2018

(65) Prior Publication Data

US 2019/0143713 A1 May 16, 2019

(30) Foreign Application Priority Data

Nov. 10, 2017 (JP) ..... 2017-216951

(51) Int. Cl.
*B41J 2/35* (2006.01)
*B41J 2/355* (2006.01)

(52) U.S. Cl.
CPC ..... *B41J 2/3553* (2013.01); *B41J 2/355* (2013.01)

(58) Field of Classification Search
CPC ... B41J 2/35; B41J 2/355; B41J 2/3551; B41J 2/3553; B41J 2/3555; B41J 2/3556; B41J 2/3558
See application file for complete search history.

(56) References Cited

U.S. PATENT DOCUMENTS

| | | | |
|---|---|---|---|
| 4,453,166 | A | 6/1984 | Enoto |
| 6,188,423 | B1 | 2/2001 | Pou |
| 6,846,055 | B2 | 1/2005 | Cartwright |
| 2011/0181677 | A1 | 7/2011 | Imaizumi |

FOREIGN PATENT DOCUMENTS

| | | | |
|---|---|---|---|
| EP | 1 247 654 | | 10/2002 |
| GB | 2 519 145 | | 4/2015 |
| JP | H07-214810 | | 8/1995 |
| JP | 2002-192760 | A | 7/2002 |
| JP | 2004-114568 | | 4/2004 |
| JP | 2006-044027 | A | 2/2006 |
| JP | 2011-148232 | A | 8/2011 |
| JP | 2017-119412 | A | 7/2017 |
| JP | 2017-119413 | A | 7/2017 |
| WO | WO-2016/066728 | | 5/2016 |

OTHER PUBLICATIONS

Extended European Search Report issued in EP Appl. No. 18205350.4 dated Mar. 26, 2019 (9 pages).

*Primary Examiner* — Kristal Feggins
(74) *Attorney, Agent, or Firm* — Foley & Lardner LLP

(57) ABSTRACT

A thermal printer has a thermal head with multiple heat elements for printing on roll paper; a measurer that measures heat element resistance; printer memory storing a resistance evaluation table relating the resistance of the heat elements to heat element defect levels defined based on a specific range of reflectivity in the symbol image; and an evaluator that references the resistance evaluation table stored in printer memory, acquires a defect level based on the resistance measured by the measurer, and evaluates the defect state of the thermal head based on the defect level of a consecutively adjacent count of heat elements.

9 Claims, 8 Drawing Sheets

211

| | F2 | | |
|---|---|---|---|
| F1 | F21 | F22 | |
| | C→D | D→F | RL1 |
| 1 | AΩ | aΩ | R1 |
| 2 | BΩ | bΩ | R2 |
| 3 | CΩ | cΩ | R3 |

FIG. 2

212

F4

| F3 | F41 | F42 | |
|---|---|---|---|
| | C→D | D→F | ← RL2 |
| SPECIFIED PAPER | $\beta$ km | $\gamma$ km | ← R4 |
| ABRASIVE PAPER | $\theta$ km | $\delta$ km | ← R5 |

FIG. 3

THERMAL PRINTER, CONTROL METHOD OF A THERMAL PRINTER, AND PRINTING SYSTEM

The present invention claims priority to Japanese Application No. 2017-216951 filed on Nov. 10, 2017 which is hereby incorporated by reference in its entirety.

BACKGROUND

1. Technical Field

The present invention relates to a thermal printer, a control method of a thermal printer, and a printing system.

2. Related Art

Technology for evaluating the operating condition of a thermal head is known from the literature. For example, JP-A-2002-192760 describes technology for sequentially applying a low voltage and measuring the current to the heat elements of a thermal head, and evaluating the operating condition (service life) of the thermal head based on the measured current and a previously set dot dropout range.

However, because the technology described in JP-A-2002-192760 does not reflect in the evaluation the print quality of the images that are actually printed, the thermal head may be determined to be malfunctioning (or to have reached its service life) even though the print quality of the printed images can be assured.

SUMMARY

With consideration for the foregoing problem, an object of the present invention is to enable appropriately evaluating the operating condition of a thermal head.

A thermal printer according to an aspect of the invention has a thermal head configured with multiple heat elements to print a symbol image on a print medium; a measurer configured to measure heat element resistance; memory configured to store relational information relating heat element resistance to defect level of a heat element defined based on a specific range of reflectivity (the percentage of light reflected when a specific amount of light is emitted, and is an indicator of print density) in the symbol image printed on the print medium; and a processor configured to reference the relational information stored in the memory, acquire the defect level based on the resistance measured by the measurer, and evaluate a defect state of the thermal head based on the defect level of a specific adjacent number of heat elements.

This configuration references relational information relating heat element resistance to the heat element defect level based on a specific range of reflectivity in the printed symbol image, and evaluates the defect state of the thermal head based on the defect level of a specific adjacent number of heat elements. As a result, the print quality of the symbol image can be appropriately reflected when evaluating the defect state of the thermal head.

In a thermal printer according to another aspect of the invention, the relational information includes, as the defect level, a first defect level corresponding to a first resistance, and a second resistance that is greater than the first resistance; and when the resistance measured by the measurer is greater than or equal to the first resistance and less than the second resistance, the processor references the relational information, acquires the first defect level, and determines the defect state of the thermal head is a state in which a defect may occur; and when the resistance measured by the measurer is greater than or equal to the second resistance, the processor references the relational information, acquires the second defect level, and determines the defect state of the thermal head is a state in which a defect has occurred.

By determining the defect state of the thermal head is a state in which a defect may occur when the first defect level is acquired, and determining the defect state of the thermal head is a state in which a defect has occurred when the second defect level is acquired, this configuration can evaluate the defect state of the thermal head in stages, and more appropriately evaluate the defect state of the thermal head.

In a thermal printer according to another aspect of the invention, the processor evaluates the defect state of the thermal head based on relational information in which a range of the defect level differs according to the specific adjacent number.

By evaluating the defect state of the thermal head based on relational information in which the defect level ranges differ according to a specific number of adjacent heat elements, this configuration can reflect the relationship between the specific number of adjacent heat elements and symbol image print quality to appropriately evaluate the defect state of the thermal head.

In a thermal printer according to another aspect of the invention, the specific adjacent number of heat elements in the relational information is determined based on a density of the heat elements in the thermal head, and a density of the symbol image.

Because the specific number of adjacent heat elements is defined in the relational information based on the heat element density and the symbol image density, this configuration can determine the specific number of adjacent heat elements based on the print quality of the symbol image, and more appropriately evaluate the defect state of the thermal head.

A thermal printer according to another aspect of the invention also has an acquirer that acquires the conveyance distance of the print medium; the memory stores distance information indicating the conveyance distance of the print medium at which the defect level changes; and the processor acquires the print medium conveyance distance, references the distance information, acquires the defect level based on the conveyance distance of the print medium, and evaluates the defect state of the thermal head based on the acquired defect level.

This configuration acquires the defect level based on the acquired conveyance distance of the print medium, and evaluates the defect state of the thermal head based on the acquired defect level, and can therefore include the conveyance distance of the print medium in the evaluation, and appropriately evaluate the defect state of the thermal head.

Another aspect of the invention is a control method of a thermal printer having a thermal head configured with multiple heat elements to print a symbol image on a print medium, and a measurer configured to measure heat element resistance, the control method including: storing relational information relating heat element resistance to defect level of a heat element defined based on a specific range of reflectivity in the symbol image printed on the print medium; and referencing the stored relational information, acquiring the defect level based on the resistance measured by the measurer, and evaluating a defect state of the thermal head based on the defect level of a specific adjacent number of heat elements.

This configuration references relational information relating heat element resistance to the heat element defect level based on a specific range of reflectivity in the printed symbol image, and evaluates the defect state of the thermal head based on the defect level of a specific adjacent number of heat elements. As a result, the print quality of the symbol image can be appropriately reflected when evaluating the defect state of the thermal head.

Another aspect of the invention is a printing system including: a thermal printer; and an information processing device capable of communicating with the thermal printer. The thermal printer includes a thermal head having multiple heat elements to print a symbol image on a print medium; a measurer configured to measure heat element resistance; a first communicator configured to communicate with the information processing device; and a first controller configured to cause the first communicator to send the resistance measured by the measurer to the information processing device. The information processing device includes a second communicator configured to communicate with the thermal printer; processing device storage configured to store relational information relating heat element resistance to defect level of a heat element defined based on a specific range of reflectivity in the symbol image printed on the print medium; and a second controller configured to reference the relational information stored in the processing device storage, acquire the defect level based on the resistance received by the second communicator, and evaluate a defect state of the thermal head based on the defect level of a specific adjacent number of heat elements.

This configuration references relational information relating heat element resistance to the heat element defect level based on a specific range of reflectivity in the printed symbol image, and evaluates the defect state of the thermal head based on the defect level of a specific adjacent number of heat elements. As a result, the print quality of the symbol image can be appropriately reflected when evaluating the defect state of the thermal head.

Other objects and attainments together with a fuller understanding of the invention will become apparent and appreciated by referring to the following description and claims taken in conjunction with the accompanying drawings.

BRIEF DESCRIPTION OF THE DRAWINGS

FIG. 2 shows an example of a resistance evaluation table.

FIG. 3 shows an example of conveyance distance evaluation table.

DESCRIPTION OF EMBODIMENTS

Embodiment 1

Figure 1:
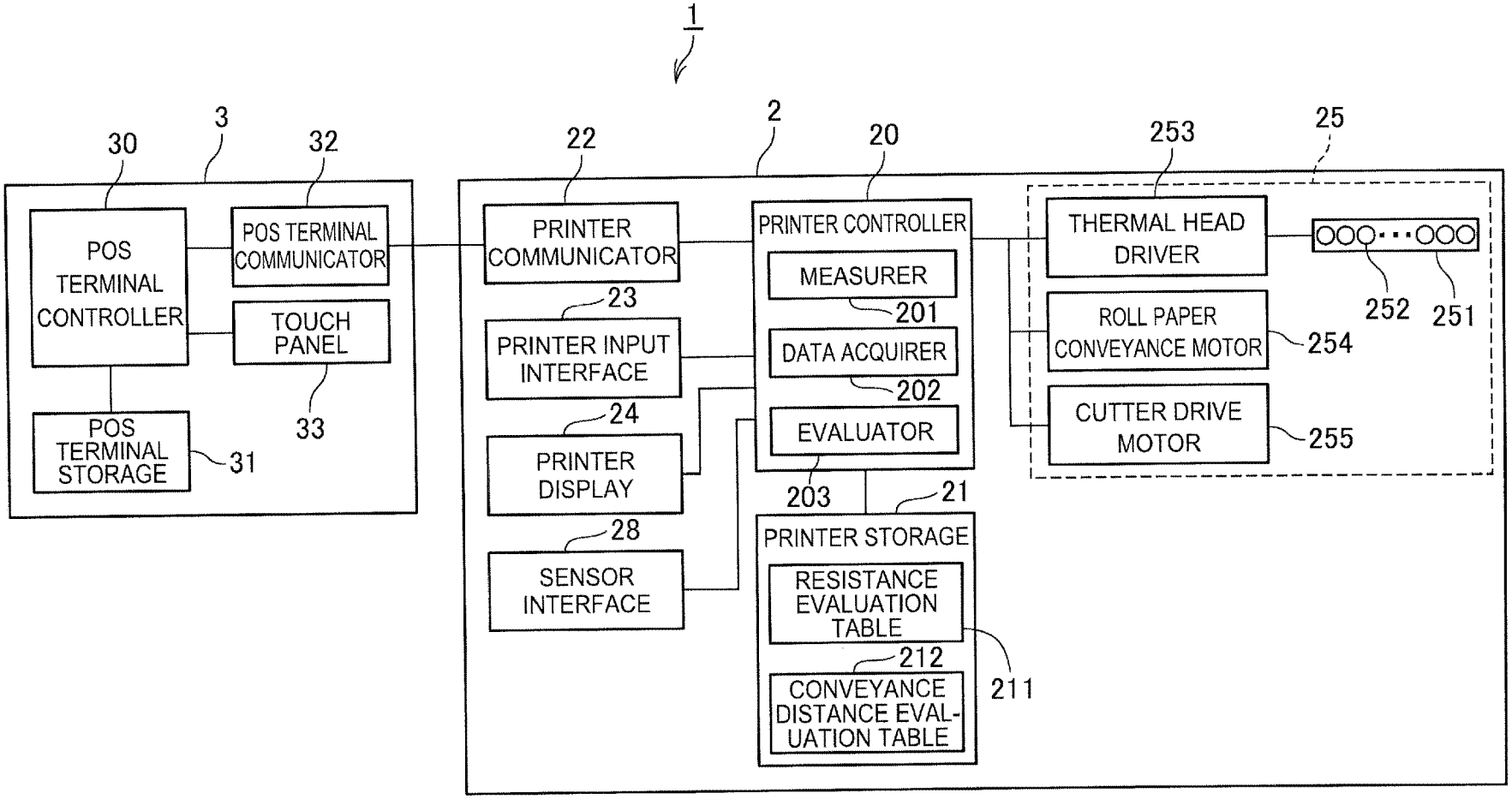
FIG. 1 is a block diagram of the configuration of a POS system according to a first embodiment of the invention.

FIG. 1 is a block diagram of the configuration of a POS (point-of-sale) system 1 (printing system) according to the first embodiment of the invention.

The POS system 1 is used in shopping centers, convenience stores, food cart sales, and other retail businesses, as well as restaurants, cafes. bar restaurants, and other hospitality businesses. The POS system 1 has functions for processing transactions based on products a customer purchases, and for producing receipts for the transactions. More specifically, when a product (including services) is sold in a store (business), the POS system 1 executes a transaction process of registering the purchased products, calculating the payment due, and processing the payment, producing receipts based on the transaction process, and providing other information related to the transaction process.

As shown in FIG. 1, the POS system 1 includes a thermal printer 2 and a POS terminal 3 (information processing device).

The thermal printer 2 is a printing device capable of printing on roll paper (print media), which in this example is thermal paper, by means of a thermal head 251.

As shown in FIG. 1, the thermal printer 2 includes a printer controller 20 (first controller, first processor), printer storage 21 (storage, memory), printer communicator 22 (first communicator, first communication board, first communication circuit, first communication port, first communication connector), printer input interface 23, printer display 24, roll paper printing mechanism 25, and sensor interface 28.

The printer controller 20 includes a CPU (processor), ROM, RAM, ASIC, or other signal processing circuit, and controls parts of the thermal printer 2. The printer controller 20 executes processes by the cooperation of hardware and software, such as a CPU reading and running firmware or programs stored in printer storage 21, executing processes by functions embedded in an ASIC, or executing processes by signal processing by a signal processing circuit.

Function blocks of the printer controller 20 include a measurer (or detector) 201, data acquirer 202, and evaluator 203 (controller). These function blocks execute processes by the cooperation of hardware and software, such as a CPU reading and running firmware or programs stored in printer storage 21. The function blocks are described below.

The printer storage 21 may be a hard disk drive, EEPROM or other nonvolatile memory, and rewritably stores data. In this example, the printer storage 21 stores a resistance evaluation table 211 (relational information), and conveyance distance evaluation table 212. These tables are described further below.

The printer communicator 22 communicates with the POS terminal 3 according to a specific communication protocol as controlled by the printer controller 20.

The printer input interface 23 has input means such as an operating panel or touch panel disposed to the thermal printer 2, detects user operations of the input means, and outputs to the printer controller 20. The printer controller 20, based on input from the printer input interface 23, executes processes corresponding to operation of the input means.

The printer display 24 comprises multiple LEDs or an operating panel, for example, and turns the LEDs on/off in a specific pattern, or displays information on the operating panel, as controlled by the printer controller 20.

The roll paper printing mechanism 25 includes a thermal head 251, thermal head driver 253, roll paper conveyance motor 254, and cutter drive motor 255.

The thermal head 251 has multiple heat elements 252 comprising resistors arrayed in a direction intersecting (such as perpendicularly to) the conveyance direction of the roll paper. The thermal head 251 prints text, images, or other content by energizing the heat elements 252 to produce heat, and applying heat to the printing surface of the roll paper, which in this example is thermal paper.

The thermal head driver 253 controls energizing the heat elements 252 of the thermal head driver 253 as controlled by the printer controller 20.

The roll paper conveyance motor 254 causes conveyance rollers to turn to convey the roll paper as controlled by the printer controller 20.

The cutter drive motor 255 drives the movable knife to slide across a fixed knife and cut the roll paper as controlled by the printer controller 20.

The sensor interface 28 detects the presence of roll paper.

Based on print data received from the POS terminal 3, the printer controller 20 controls the roll paper printing mechanism 25 to produce receipts.

The POS terminal 3 in this example is a tablet computer having a touch panel 33 disposed over a large part of the front. Note that the POS terminal 3 may also be a desktop terminal such a as a personal computer. The POS terminal 3 functions as a host computer that executes transaction processes and controls the thermal printer 2.

As shown in FIG. 1, the POS terminal 3 includes a POS terminal controller 30 (second controller, second processor), POS terminal storage 31 (processing device storage, processing device memory), POS terminal communicator 32 (second communicator, second communication board, second communication circuit, second communication port, second communication connector), and touch panel 33.

The POS terminal controller 30 includes a CPU (processor), ROM, RAM, ASIC, or other signal processing circuit, and controls parts of the POS terminal 3. The POS terminal controller 30 executes processes by the cooperation of hardware and software, such as a CPU reading and running firmware or programs stored in POS terminal storage 31, executing processes by functions embedded in an ASIC, or executing processes by signal processing by a signal processing circuit.

The POS terminal storage 31 may be a hard disk drive, EEPROM or other nonvolatile memory, and rewritably stores data.

The POS terminal communicator 32 communicates with the thermal printer 2 according to a specific communication protocol as controlled by the POS terminal controller 30.

The touch panel 33 has a display panel such as an LCD panel, and a touch sensor disposed over or in unison with the display panel. The display panel displays images as controlled by the POS terminal controller 30. The touch sensor detects touch operations, and outputs to the POS terminal controller 30. The POS terminal controller 30, based on input from the touch sensor, executes processes executes processes corresponding to the touch operation.

The resistance evaluation table 211 and conveyance distance evaluation table 212 are described next.

FIG. 2 shows an example of a resistance evaluation table 211.

As shown in FIG. 2, the resistance evaluation table 211 relationally stores a consecutively adjacent count field F1, and heat element defect level field F2. The heat element defect level field F2 includes a first defect level field F21 and a second defect level field F22.

The multiple heat elements 252 are disposed to the thermal head 251 in a single row. The consecutively adjacent count field F1 stores the number of consecutively adjacent heat elements 252 expressing a specific resistance (referred to below as the consecutively adjacent count (specific adjacent number)).

The heat element defect level field F2 relationally stores defect level information indicating a defect level, which expresses the degree of heat element 252 malfunction, and the resistance of the heat element 252 corresponding to the defect level indicated by the defect level information.

As described above, the heat element defect level field F2 includes a first defect level field F21 and a second defect level field F22.

The first defect level field F21 relationally stores first defect level information indicating a first defect level at which the degree of heat element 252 malfunction is lower than the second defect level information described below, and the resistance (referred to below as the first defect level resistance (first resistance)) of the heat element 252 corresponding to the first defect level indicated by the first defect level information. As the first defect level information indicating a first defect level, the first defect level field F21 of the resistance evaluation table 211 in FIG. 2 stores a first defect level resistance of A Ω, a first defect level resistance of B Ω, and a first defect level resistance of C Ω.

The second defect level field F22 relationally stores second defect level information indicating a second defect level indicating a degree of heat element 252 malfunction that is higher than the first defect level, and the resistance (referred to below as the second defect level resistance (second resistance)) of the heat element 252 corresponding to the second defect level indicated by the second defect level information. As the second defect level information indicating a second defect level, the second defect level field F22 of the resistance evaluation table 211 in FIG. 2 stores a second defect level resistance of a Ω, a second defect level resistance of b Ω, and a second defect level resistance of c Ω.

In this embodiment of the invention, the relationship between the resistances stored in the resistance evaluation table 211 is a Q>=AΩ>=bΩ>=BΩ>=cΩ>=CΩ.

The defect level information C→D and D→F stores in record RL1 in FIG. 2 is described next.

Here, C, D, and F are the symbols indicating the quality level defined for barcode printing (including multilevel barcodes and binary codes) (barcode symbol images) as defined by ANSI (American National Standard Institute) and Japan Industrial Standards Committee (JIS) (that is, the print quality, referred to below as the quality level). The quality level of the barcodes defined by these standards are described below.

Quality level A: quality level of a barcode that can be read in a single scan by the barcode scanner Quality level B: quality level of a barcode that can be read by scanning the same place multiple times Quality level C: quality level of a barcode that can be read by scanning a different part of the barcode Quality level D: quality level of a barcode that can be read by scanning a different part of the barcode multiple times Quality level F: quality level of a barcode that should normally not be used Based on the quality levels described above, the first defect level of C→D in this embodiment indicates a heat element 252 defect (malfunction) level at which the quality level of the barcode changes from quality level C to quality level D. Likewise, a second defect level of D→F indicates a heat element 252 defect (malfunction) level at which the quality level of the barcode changes from quality level D to quality level F.

As shown in FIG. 2, record R1 relates a consecutively adjacent count of 1 to a first defect level resistance of A Ω, and a second defect level resistance of a Ω. Based on the relationship shown in record RL1 and record R1 in resistance evaluation table 211, a first defect level resistance of A Ω corresponds to a first defect level information indicating C→D, and a second defect level resistance of a Ω corresponds to second defect level information indicating D→F.

The correlation shown in record R1 and the relationship between record R1 and record RL1 indicates the following relation. That is, if the resistance of a single heat element 252 is less than a Ω and is greater than or equal to A Ω, the defect level of the heat element 252 is the first defect level. If the resistance of a single heat element 252 is greater than or equal to a Ω, the defect level of the heat element 252 is the second defect level.

As shown in FIG. 2, record R2 relates a consecutively adjacent count of 2 to a first defect level resistance of B Ω, and a second defect level resistance of b Ω. Based on the relationship shown in record RL1 and record R2, a first defect level resistance of B Ω corresponds to a first defect level information indicating C→D, and a second defect level resistance of b Ω corresponds to second defect level information indicating D→F.

The correlation shown in record R2 and the relationship between record R2 and record RL1 indicates the following relation. That is, if the resistance of two consecutively adjacent heat elements 252 is less than b Ω and is greater than or equal to B Ω, the defect level of the heat element 252 is the first defect level. If the resistance of two consecutively adjacent heat elements 252 is greater than or equal to b Ω, the defect level of the heat element 252 is the second defect level.

As shown in FIG. 2, record R3 relates a consecutively adjacent count of 3 to a first defect level resistance of C Ω, and a second defect level resistance of c Ω. Based on the relationship shown in record RL1 and record R3, a first defect level resistance of C Ω corresponds to a first defect level information indicating C→D, and a second defect level resistance of c Ω corresponds to second defect level information indicating D→F.

The correlation shown in record R3 and the relationship between record R3 and record RL1 is the same as the relationship with record R1 and record R2.

The resistance evaluation table 211 shown in FIG. 2 is compiled by tests or simulations using a device (such as a barcode verifier) that evaluates the quality level of the printed barcode symbols according to the standards described above, and is stored in printer storage 21. Note that a barcode symbol image includes linear barcodes and two-dimensional barcodes, and is an image that can be read with a scanner.

For example, the barcode verifier stores the first defect level resistance in the resistance evaluation table 211 based on the results of measuring the resistance of the heat elements 252 at which the evaluation changes from quality level C to quality level D based on a specific range of reflectivity of a barcode determined to be quality level C, and a specific range of reflectivity of a barcode determined to be quality level D (such as the bar density and bar width). Likewise, the barcode verifier stores the second defect level resistance in the resistance evaluation table 211 based on the results of measuring the resistance of the heat elements 252 at which the evaluation changes from quality level D to quality level F based on a specific range of reflectivity of a barcode determined to be quality level F, and a specific range of reflectivity of a barcode determined to be quality level D (such as the bar density and bar width).

The resistance evaluation table 211 shown in FIG. 2 is also compiled by previous tests or simulations so that the first defect level resistance and second defect level resistance differ according to the consecutively adjacent count.

For example, one bar of a barcode may be printed by driving multiple (such as four) consecutively adjacent heat elements 252 to heat and form a bar of a specific width defined by the barcode standard. In this case, if the resistance of one of the multiple consecutively adjacent heat element 252 forming one bar is high, the heat output is therefore low, and the reflectivity is high (the print density is low), that is, is white, the bar may be read as a thin bar and deviate from the barcode standard. The white portion of this single bar will therefore be separated from the other black parts, and this part of the barcode may be read as multiple bars, or the thickness of the bar may be outside the barcode standard. In this way, the consecutively adjacent count of the heat elements 252 affects the print quality of the barcode symbol image. The likelihood of this happening increases the consecutively adjacent count increases. The first defect level resistance and second defect level resistance are therefore set low in the resistance evaluation table 211 shown in FIG. 2 so that this can be determined more strictly as the consecutively adjacent count increases.

Note that the resistance evaluation table 211 shown in FIG. 2 is compiled based on tests or simulations of a multilevel barcode (barcode symbol image) as an example of the symbol image. The effect of this is described below.

The conveyance distance evaluation table 212 is described next.

FIG. 3 shows an example of a conveyance distance evaluation table 212.

As shown in FIG. 3, the conveyance distance evaluation table 212 relationally stores a media type field F3 and a heat element defect level field F4 in each stored record. The heat element defect level field F4 relationally stores a first defect level field F41 and a second defect level field F42.

The FIG. 3 stores type information indicating the type of roll paper. The media type field F3 of the conveyance distance evaluation table 212 shown in FIG. 3 stores type information indicating Specified Paper and type information indicating Abrasive Paper. Specified Paper is the type of roll paper recommended for printing with the thermal printer 2 by the manufacturer of the thermal printer 2.

The heat element defect level field F4 relationally stores defect level information indicating a defect level, which expresses the degree of heat element 252 malfunction, and total conveyance distance information (distance information) indicating the total conveyance distance that the roll paper has been conveyed (referred to below as total conveyance distance).

As described above, the heat element defect level field F4 includes a first defect level field F41 and a second defect level field 42.

The first defect level field F41 relationally stores first defect level information indicating a first defect level as described above, and total conveyance distance information corresponding to the first defect level indicated by the first defect level information. The first defect level field F41 of the conveyance distance evaluation table 212 in FIG. 3 relationally stores, to first defect level information indicating a first defect level of C→D, total conveyance distance information indicating β km, and total conveyance distance information indicating θ km.

The second defect level field F42 relationally stores second defect level information indicating a second defect level as described above, and total conveyance distance information corresponding to the second defect level indicated by the second defect level information. The second defect level field F42 of the conveyance distance evaluation table 212 in FIG. 3 relationally stores, to second defect level information indicating a second defect level of D→F, total conveyance distance information indicating γ km, and total conveyance distance information indicating δ km.

In the total conveyance distance information in this embodiment, γ km>=β km, and δ km>=θ km.

The defect level information C→D and D→F stored in record RL2 in FIG. 3 is the same as the defect level information described above.

As shown in FIG. 3, record R4 relationally stores type information indicating Specified Paper to total conveyance distance information β km, and total conveyance distance information γ km. Based on the relationship shown in record RL2 and record R4, total conveyance distance information of γ km corresponds to a first defect level information indicating D→F, and total conveyance distance information indicating δ km corresponds to first defect level information indicating C→D.

The correlation shown in record R4 and the relationship between record R4 and record RL2 indicates the following. If the roll paper is Specified Paper and the total conveyance distance is greater than or equal to γ km, the defect level of at least one heat element 252 is the second defect level. If the roll paper is Specified Paper and the total conveyance distance is less than γ km and greater than or equal to β km, the defect level of at least one heat element 252 is the first defect level.

As shown in FIG. 3, record R5 relationally stores type information indicating Abrasive Paper to total conveyance distance information θ km, and total conveyance distance information δ km. Based on the relationship shown in record RL2 and record R5, total conveyance distance information of δ km corresponds to a second defect level information indicating D→F, and total conveyance distance information indicating θ km corresponds to first defect level information indicating C→D.

The correlation shown in record R4 and the relationship between record R5 and record RL2 indicates the following. If the roll paper is Abrasive Paper and the total conveyance distance is greater than or equal to δ kin, the defect level of at least one heat element 252 is the second defect level. If the roll paper is Abrasive Paper and the total conveyance distance is less than δ km or within the range of θ km or greater than or equal to this range, the defect level of at least one heat element 252 is the first defect level.

The conveyance distance evaluation table 212 shown in FIG. 3 is compiled by tests or simulations based on the correlation between heat element 252 resistance and the total conveyance distance the roll paper is conveyed.

Figure 4:
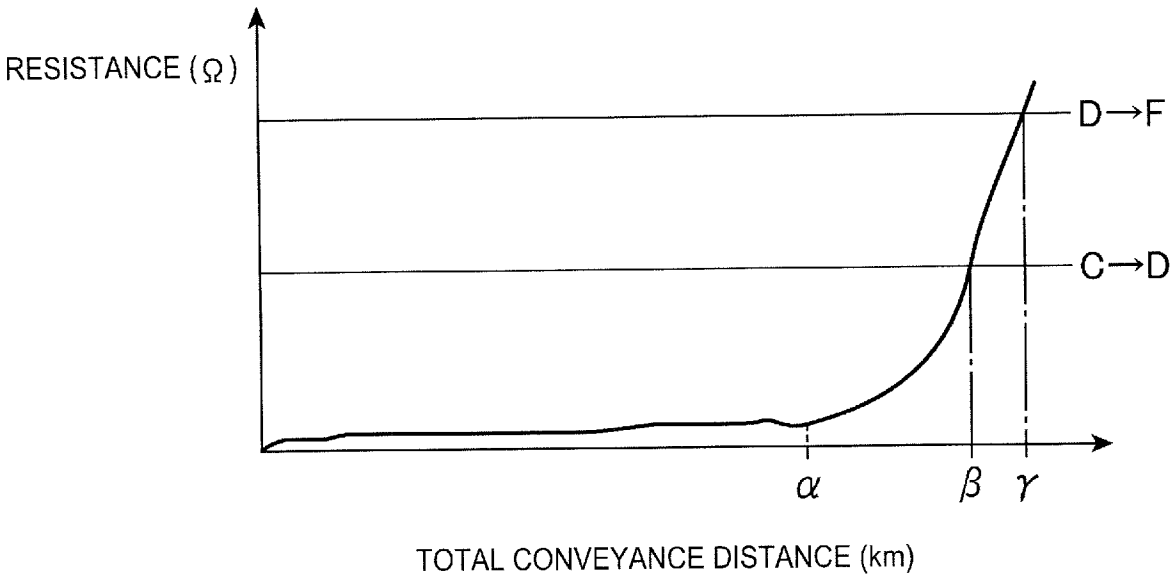
FIG. 4 is a graph of the relationship between heat element resistance and total conveyance distance.

FIG. 4 is a graph showing the relationship between heat element 252 resistance and the total conveyance distance. In FIG. 4, the Y-axis shows heat element 252 resistance in ohms (a). In FIG. 4, the X-axis shows the total conveyance distance in kilometers (km). FIG. 4 illustrates the relationship when the roll paper type is Specified Paper.

As shown in FIG. 4, this correlation shows a gradual rise in the heat element 252 resistance until the total conveyance distance reaches approximately α km, and a sharp rise in the heat element 252 resistance after approximately α km.

FIG. 4 shows that β km is the total conveyance distance at which the quality level of the symbol image changes from quality level C to quality level D, and is the total conveyance distance corresponding to the first defect level resistance described above. In addition, γ km is the total conveyance distance at which the quality level of the symbol image changes from quality level D to quality level F, and is the total conveyance distance corresponding to the second defect level resistance described above.

The conveyance distance evaluation table 212 stores the total conveyance distance information indicating β km in the first defect level field F41, and stores the total conveyance distance information indicating γ km in second defect level field F42.

Evaluating the defect level of the thermal head 251 based on resistance evaluation table 211 and conveyance distance evaluation table 212 is described next.

Figure 5:
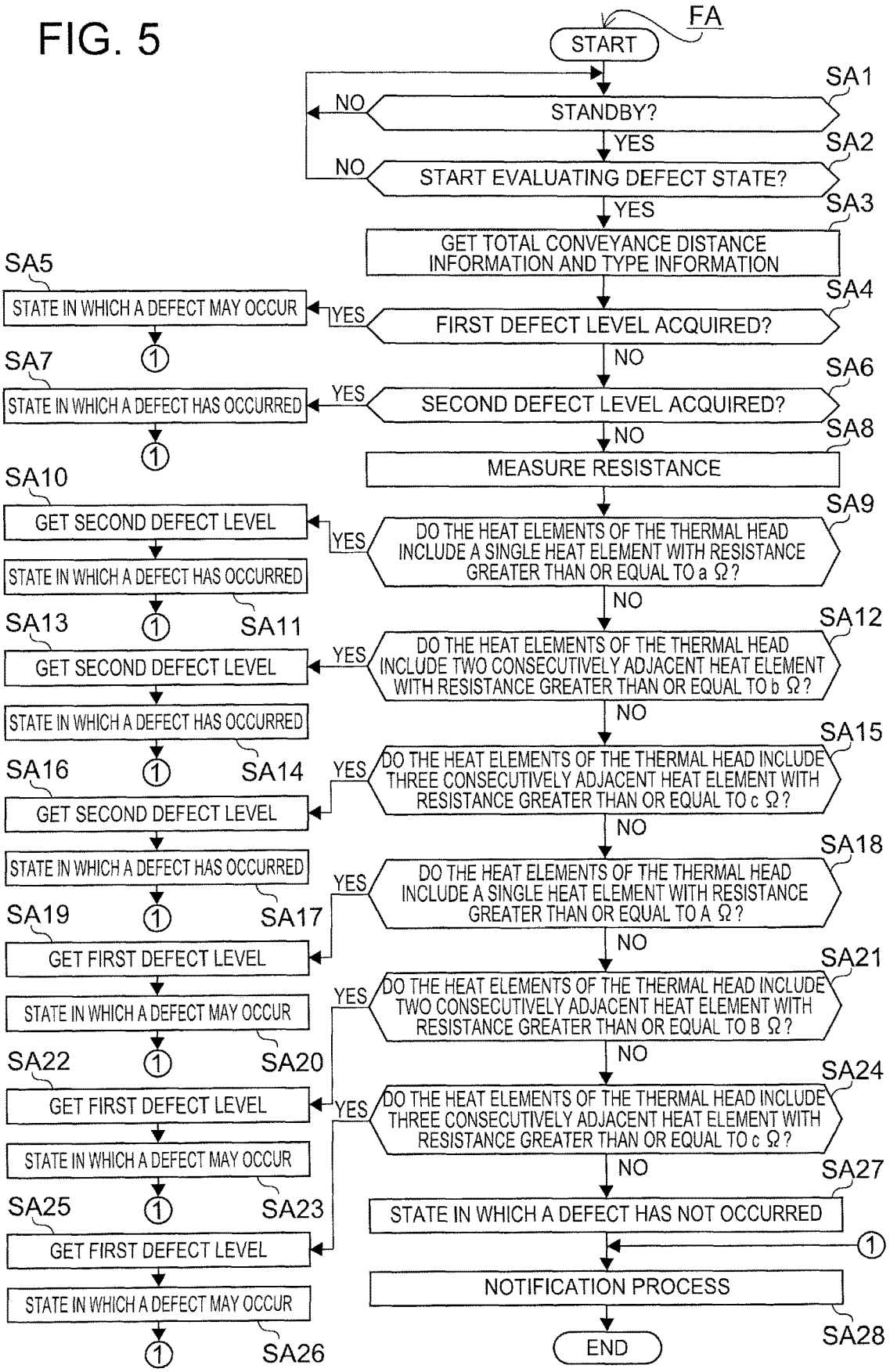
FIG. 5 is a flow chart of thermal printer operation.

FIG. 5 is a flow chart FA of the operation of the thermal printer 2. Operation of the thermal printer 2 is described below through description of the measurer 201, data acquirer 202, and evaluator 203 of the printer controller 20.

As will be understood from the following, in the operation shown in FIG. 5 the evaluator 203 of the printer controller 20 uses 3 as the maximum consecutively adjacent count for determining the defect level of the thermal head 251. This maximum value is determined based on the density of the heat elements 252 on the thermal head 251 and the density of the symbol image at a specific time before the operation shown in FIG. 5 starts or before the operation shown in step SA9 starts.

An exemplary method of determining the maximum consecutively adjacent count is described next.

The evaluator 203 of the printer controller 20 calculates the horizontal width of a two-dimensional code (2D code, such as a QR code (R)) of a minimum size. For example, if the width of one cell is 0.5 mm, and the 2D code is 11 cells wide, the evaluator 203 computes 0.5 mm×11 cells to get a horizontal width of 5.5 mm.

Next, the evaluator 203 calculates the horizontal width of the thermal head 251 (the length from the heat element 252 at one end to the heat element 252 at the opposite end). For example, if the dot density of the heat element 252 per inch, that is, the resolution of the thermal head 251, is 180 dpi (dots per inch), and the thermal head 251 has 512 heat elements 252, the evaluator 203 computes 512 dots÷180 dpi×25.4 mm, and determines the horizontal width of the thermal head 251 is 72.25 mm.

Next, the evaluator 203 calculates the correctable damage length on the horizontal width of a 2D code of the smallest size. For example, if the correctable damage level is 7%, the evaluator 203 calculates the correctable damage length as 5.5 mm×7% or 0.385 mm.

Next, the evaluator 203 calculates the maximum consecutively adjacent count as 512 dots=72.25 mm=a maximum correctable damage length of 0.385 mm=2.728 dots, rounded to an integer value of a maximum 3.

The calculated maximum consecutively adjacent count indicates a threshold at which reading is difficult even with error correction. More specifically, this indicates that a thermal head 251 having three consecutive heat elements 252 that heat improperly may print a 2D code that is difficult to read. The maximum consecutively adjacent count is based on reading a 2D code, but is also valid for barcodes and other linear codes. A thermal head 251 having three consecutive heat elements 252 that heat improperly may therefore also print linear codes that are difficult to read.

Operation of the thermal printer 2 when the evaluator 203 determines the maximum consecutively adjacent count is 3 is described next.

As shown in FIG. 5, the printer controller 20 of the thermal printer 2 first determines if the operating state of the thermal printer 2 is the standby state (step SA1). Examples of a standby state include waiting for print data from the POS terminal 3, and the roll paper printing mechanism 25 not executing a printing process.

If the printer controller 20 determines the operating state of the thermal printer 2 is a standby state (step SA1: YES), the printer controller 20 determines whether or not to start evaluating the thermal head 251 for defective operation (step SA2). For example, if a specific time has past since the operating state of the thermal printer 2 entered a standby state, the printer controller 20 determines to start evaluating the thermal head 251 for defective operation triggered by the passage of this specific time (step SA2: YES). If the thermal printer 2 is in the standby state and the user has input a command to evaluate the defect level of the thermal head 251, the printer controller 20 determines to start evaluating the defect level of the thermal head 251 (step SA2: YES).

When the printer controller 20 determines to start evaluating the defect level of the thermal head 251 (step SA2: YES), the data acquirer 202 of the printer controller 20 acquires total conveyance distance information indicating the total conveyance distance, and type information indicating the type of roll paper the thermal printer 2 prints on (step SA3). When the printer storage 21 stores the total conveyance distance information, the data acquirer 202 acquires the total conveyance distance information from the printer storage 21 in step SA3.

The total conveyance distance information is information updated by the total conveyance distance each time the roll paper is conveyed. Note that the conveyance distance is calculated based on the number of steps the roll paper conveyance motor 254 is driven. When the printer storage 21 also stores type information, the data acquirer 202 acquires the type information from the printer storage 21 in step SA3. The printer storage 21 stores the type of roll paper loaded the first time the thermal printer 2 is turned on as the type information.

Next, once the data acquirer 202 acquires the total conveyance distance information and type information, the evaluator 203 of the printer controller 20 references the conveyance distance evaluation table 212 stored in the printer storage 21, and determines if the defect level of heat elements 252 of the thermal head 251 is the first defect level (step SA4).

The process of step SA4 is described next.

In this example of the process executed in step SA4, the data acquirer 202 acquires type information indicating Specified Paper.

First, the evaluator 203 finds the record R4 storing type information indicating Specified Paper in the media type field F3 of the conveyance distance evaluation table 212. Next, the evaluator 203 determines if the total conveyance distance information the data acquirer 202 acquired is greater than or equal to β km and less than γ km based on the acquired record R4. If the total conveyance distance is greater than or equal to β km and less than γ km, the evaluator 203 acquires, based on the relationship between record R4 and record RL2 in the conveyance distance evaluation table 212, defect level information indicating the first defect level of C→D. When the evaluator 203 acquires defect level information indicating the first defect level from the conveyance distance evaluation table 212, the evaluator 203 determines the defect level of heat elements 252 of the thermal head 251 is the first defect level.

When the evaluator 203 determines the defect level of heat elements 252 of the thermal head 251 is the first defect level (step SA4: YES), the evaluator 203 determines the defect state of the thermal head 251 may lead to a printhead malfunction (step SA5). As described above, the first defect level indicates a heat element 252 defect level at which the quality level of the printed barcode changes from quality level C to quality level D. Quality level D is the quality level of a barcode that can be read by scanning a different part of the barcode multiple times according to a specific standard, and is one level higher than the lowest level, quality level F. The decision made by the evaluator 203 in step SA5 is therefore a decision appropriately reflecting barcode print quality.

Returning to step SA4, if the defect level of a heat element 252 of the thermal head 251 is not the first defect level (step SA4: NO), the evaluator 203 determines if the defect level of heat elements 252 of the thermal head 251 is the second defect level (step SA6). Here, the evaluator 203 executes the step SA6 by the same process determining whether or not the defect level is the first defect level.

When the evaluator 203 determines the defect level of heat elements 252 of the thermal head 251 is the second defect level (step SA6: YES), the evaluator 203 determines the defect state of the thermal head 251 is a malfunctioning state (step SA7). As described above, the second defect level indicates a heat element 252 defect level at which the quality level of the printed barcode changes from quality level D to quality level F. Quality level F is the quality level of a barcode that should normally not be used according to a specific standard, and is the lowest quality level. The decision made by the evaluator 203 in step SA7 is therefore a decision appropriately reflecting barcode print quality.

The evaluator 203 determines the defect level of the heat elements 252 of the thermal head 251 based on the total conveyance distance of the roll paper, and based on the acquired defect level evaluates the malfunctioning state of the thermal head 251. The evaluator 203 thus uses the total conveyance distance of the roll paper when evaluating the malfunctioning state of the thermal head 251. As shown in FIG. 4, the correlation between the total conveyance distance and heat element 252 resistance is a relationship in which the heat element 252 resistance increases as the conveyance distance increases. In other words, as the total conveyance distance increases, the quality of barcodes printed by the thermal head 251 decreases. By referencing a conveyance distance evaluation table 212 based on the correlation between total conveyance distance and heat element 252 resistance, the evaluator 203 can make a decision based on the correlation between total conveyance distance and heat element 252 resistance, and can appropriately evaluate the malfunctioning state of the thermal head 251.

Returning to step SA6, if the defect level of a heat element 252 of the thermal head 251 is not the second defect level (step SA6: NO), the measurer 201 of the printer controller 20 measures the resistance of each heat element 252 of the thermal head 251 (step SA8). For example, the measurer 201 controls the thermal head driver 253 to apply a specific voltage to each heat element 252 of the thermal head 251. The measurer 201 then measures the current flow to each heat element 252, and based on the detected current and the voltage applied to each heat element 252, measures the resistance of each heat element 252 of the thermal head 251. Note that the measurement method used by the measurer 201 is not specifically limited to this method, and other methods may be used.

Next, when the measurer 201 has measured the resistance of each heat element 252 of the thermal head 251, the evaluator 203 of the printer controller 20, based on the resistance detected by the measurer 201, determines individually for each heat element 252 of the thermal head 251 whether the resistance of the heat element 252 greater than or equal to a Ω (step SA9). For example, the evaluator 203 selects all of the heat elements 252 one by one, and compares the measured resistance of the selected heat element 252 with the second defect level resistance (in step SA9, a Ω).

If the evaluator 203 determines the resistance of the selected heat element 252 is greater than or equal to a Ω (step SA9: YES), the evaluator 203 references the resistance evaluation table 211, and based on the correlation between record R1 and record RL1, acquires the second defect level as the defect level of that heat element 252 of the thermal head 251 (step SA10). When the second defect level is acquired, the evaluator 203 determines that the thermal head 251 is malfunctioning (step SA11).

Returning to step SA9, if the evaluator 203 determines the resistance of the selected (individual) heat element 252 is not greater than or equal to a Ω (step SA9: NO), the evaluator 203 determines if there are two consecutive heat element 252 with a resistance of b Ω or greater in the heat elements 252 of the thermal head 251 (step SA12).

In this example, the evaluator 203 selects multiple heat elements 252 two at a time to make this decision. When selecting two heat elements 252, the evaluator 203 selects one of the two previously evaluated heat elements 252 and the one adjacent heat element 252 that has not yet been evaluated as the next pair of heat elements 252 to evaluate.

If the evaluator 203 detects two consecutive heat elements 252 with a resistance of b Ω or greater (step SA12: YES), the evaluator 203 references the resistance evaluation table 211, and based on the correlation between record R2 and record RL1, acquires the second defect level as the defect level of the heat elements 252 of the thermal head 251 (step SA13). When the second defect level is acquired, the evaluator 203 determines that the thermal head 251 is malfunctioning (step SA14).

Returning to step SA14, if the evaluator 203 determines the resistance of the selected (individual) heat element 252 is not greater than or equal to a Ω (step SA9: NO), the evaluator 203 determines if there are two consecutive heat element 252 with a resistance of b Ω or greater in the heat elements 252 of the thermal head 251 (step SA12).

In this example, the evaluator 203 selects multiple heat elements 252 two at a time to make this decision. When selecting two heat elements 252, the evaluator 203 selects one of the two previously evaluated heat elements 252 and the one adjacent heat element 252 that has not yet been evaluated as the next pair of heat elements 252 to evaluate.

If the evaluator 203 detects two consecutive heat elements 252 with a resistance of b Ω or greater (step SA12: YES), the evaluator 203 references the resistance evaluation table 211, and based on the correlation between record R2 and record RL1, acquires the second defect level as the defect level of the heat elements 252 of the thermal head 251 (step SA13). When the second defect level is acquired, the evaluator 203 determines that the thermal head 251 is malfunctioning (step SA14).

Returning to step SA15, if the evaluator 203 determines there are not two consecutive heat elements 252 with a resistance of b Ω or greater in the heat elements 252 of the thermal head 251 (step SA12: NO), the evaluator 203 determines if there are three consecutive heat element 252 with a resistance of c Ω or greater in the heat elements 252 of the thermal head 251 (step SA15).

In this example, the evaluator 203 selects multiple heat elements 252 three at a time to make this decision. When selecting three heat elements 252, the evaluator 203 selects two of the two previously evaluated heat elements 252 and the one adjacent heat element 252 that has not yet been evaluated as the next set of three heat elements 252 to evaluate.

If the evaluator 203 detects three consecutive heat elements 252 with a resistance of c Ω or greater (step SA15: YES), the evaluator 203 references the resistance evaluation table 211, and based on the correlation between record R3 and record RL1, acquires the second defect level as the defect level of the heat elements 252 of the thermal head 251 (step SA16). When the second defect level is acquired, the evaluator 203 determines that the thermal head 251 is malfunctioning (step SA17).

Returning to step SA17, if the evaluator 203 determines there are not three consecutive heat elements 252 with a resistance of c Ω or greater in the heat elements 252 of the thermal head 251 (step SA15: NO), the evaluator 203 determines individually for each heat element 252 of the thermal head 251 whether the resistance of the heat element 252 greater than or equal to A Ω (step SA18). Because the process of step SA18 executes after the process of step SA9, this evaluation determines if the resistance is less than a Ω and greater than or equal to A Ω.

If the evaluator 203 determines the resistance of the selected heat element 252 is greater than or equal to A Ω (step SA18: YES), the evaluator 203 references the resistance evaluation table 211, and based on the correlation between record R1 and record RL1, acquires the first defect level as the defect level of the heat element 252 of the thermal head 251 (step SA19). When the first defect level is acquired, the evaluator 203 determines the defect state of the thermal head 251 may lead to a printhead malfunction (step SA20).

Returning to step SA18, if the evaluator 203 determines the resistance of the selected (individual) heat element 252 is not greater than or equal to A Ω (step SA18: NO), the evaluator 203 determines if there are two consecutive heat elements 252 with a resistance of B f or greater in the heat elements 252 of the thermal head 251 (step SA21). Because the process of step SA21 executes after the process of step SA12, this evaluation determines if the resistance is less than b Ω and greater than or equal to B Ω.

If the evaluator 203 detects two consecutive heat elements 252 with a resistance of B Ω or greater (step SA21: YES), the evaluator 203 references the resistance evaluation table 211, and based on the correlation between record R2 and record RL1, acquires the first defect level as the defect level of the heat elements 252 of the thermal head 251 (step SA22). When the first defect level is acquired, the evaluator 203 determines the defect state of the thermal head 251 may lead to a printhead malfunction (step SA23).

Returning to step SA21, if the evaluator 203 determines there are not two consecutive heat elements 252 with a resistance of B Ω or greater in the heat elements 252 of the thermal head 251 (step SA21: NO), the evaluator 203 determines if there are three consecutive heat element 252 with a resistance of C Ω or greater in the heat elements 252 of the thermal head 251 (step SA24). Because the process of step SA24 executes after the process of step SA15, this evaluation determines if the resistance is less than c Ω and greater than or equal to C Ω.

If the evaluator 203 detects three consecutive heat elements 252 with a resistance of C Ω or greater (step SA24: YES), the evaluator 203 references the resistance evaluation table 211, and based on the correlation between record R3 and record RL1, acquires the first defect level as the defect level of the heat elements 252 of the thermal head 251 (step SA25). When the second defect level is acquired, the evaluator 203 determines the defect state of the thermal head 251 may lead to a printhead malfunction (step SA26).

Returning to step SA24, if the evaluator 203 determines there are not three consecutive heat elements 252 with a resistance of C Ω or greater in the heat elements 252 of the thermal head 251 (step SA24: NO), the evaluator 203 determines the thermal head 251 is not malfunctioning (step SA27).

As described above, the evaluator 203 references a resistance evaluation table 211, acquires a defect level of the heat elements 252 of the thermal head 251 based on the resistance measured by the measurer 201, and evaluates the defect state of the thermal head 251 based on the defect level. More specifically, the evaluator 203 evaluates the defect state of the thermal head 251 based on the defect level of the heat elements 252 corresponding to the consecutively adjacent count.

As described above, the resistance evaluation table 211 stores resistance values (first defect level resistance and second defect level resistance) at which the quality level defined by a known standard changes, and the defect level information of the heat elements 252 indicating the resistance. By evaluating the defect state of the thermal head 251 based on the defect level acquired by referencing the resistance evaluation table 211, the evaluator 203 can reflect the print quality of the printed symbol image to appropriately evaluate the defect state of the thermal head 251.

Technology for evaluating the defect state of a thermal head 251 based simply on the relationship between heat element 252 resistance and a specific resistance is known from the literature. With the technology of the related art, however, a thermal head 251 may be determined to be defective even though barcodes of quality level C and above can be printed. By evaluating the thermal head 251 as described above, however, the evaluator 203 can evaluate the defect state of the thermal head 251 to appropriately reflect the print quality of barcode symbols.

If the resistance the measurer 201 measures is greater than or equal to a first defect level resistance and less than a second defect level resistance, the evaluator 203 acquires the first defect level, and determines that the defect state of the thermal head 251 is a state in which a printhead malfunction may occur.

If the resistance the measurer 201 measures is greater than or equal to a second defect level resistance, the evaluator 203 acquires the second defect level, and determines that the defect state of the thermal head 251 indicates a printhead malfunction. As a result, the evaluator 203 can evaluate the state of the thermal head 251 in two levels, a malfunctioning state because a defect has occurred, or a potential malfunctioning state in which a defect may occur, and can therefore more appropriately determine the state of the thermal head 251 defects.

The evaluator 203 also evaluates the thermal head 251 based on the range of the defect level changing according to the consecutively adjacent count. The range of the defect level is the range of values acquired as a first defect level or second defect level. For example, if the consecutively adjacent count is 1, the range of the first defect level is resistance less than a Ω and greater than or equal to A Ω, and the range of the second defect level is a resistance greater than or equal to a Ω. If the consecutively adjacent count is 2, the range of the first defect level is resistance less than b Ω and greater than or equal to B Ω, and the range of the second defect level is a resistance greater than or equal to b Ω.

As described above, the print quality of a barcode image is affected by the consecutively adjacent count of heat elements 252. By basing the evaluation on the defect level range differing according to the consecutively adjacent count, the evaluator 203 can determine the defect state of the thermal head 251 appropriately to reflect the relationship between the consecutively adjacent count and the print quality of the barcode symbol image.

The evaluator 203 also evaluates the defect state of the thermal head 251 by referencing a resistance evaluation table 211 compiled for a multilevel barcode. As known from the literature, a multilevel barcode comprises a combination of narrow bars, wide bars, narrow spaces, and wide spaces, and the allow range of ratios between bars and spaces is much larger than a binary level barcode. As a result, the quality level of a multilevel barcode must meet a stricter standard than a binary level barcode. In addition, because a multilevel barcode for acquiring information based on the width of the bars and reflectivity, evaluating the quality level is more difficult than a 2D code enabling acquiring information by grayscale and error correction. By evaluating the defect state of the thermal head 251 by referencing a resistance evaluation table 211 based on the quality level of the multilevel barcode, the evaluator 203 can reflect the print quality of various barcode images (at least multilevel barcodes, binary level barcodes, and 2D codes) when evaluating the defect state of the thermal head 251.

The evaluator 203 determines the maximum consecutively adjacent count based on the density of heat elements 252 in the thermal head 251 and the density of the symbol image, and evaluates the defect state of the thermal head 251 based on this maximum count. Because the maximum consecutively adjacent count is determined based on the density of heat elements 252 in the thermal head 251 and the density of the symbol image, the evaluator 203 can also use the print quality of the symbol image to determine the consecutively adjacent count. The evaluator 203 also acquires the defect level and determines the defect state of the thermal head 251 based on this consecutively adjacent count. As a result, there is a low chance of determining the defect state of the thermal head 251 indicates a defect (malfunction) has not occurred even though the print quality of the printed symbol image is low. The evaluator 203 can therefore appropriately evaluate the defect state of the thermal head 251.

Returning to the flow chart shown in FIG. 5, the evaluator 203 executes a reporting process based on the result of the evaluation when the defect state of the thermal head 251 has been determined (step SA28). The reporting process in this embodiment is a process of reporting the result of the evaluation. Multiple examples of a reporting process are described below.

First Reporting Process

In the first reporting process, information indicating that the defect state of the thermal head 251 is that a defect has occurred is reported by the printer display 24, for example, when the evaluator 203 makes the decision of step SA7, step SA11, step SA14, or step SA17, and when the evaluator 203 makes the decision of step SA5, step SA20, step SA23, or step SA26, information indicating that the defect state of the thermal head 251 is that a defect may occur is reported.

As a result, at least the user of the thermal printer 2 can know that the defect state of the thermal head 251 is that a malfunction has occurred or that a malfunction may occur. The evaluator 203 reports the information indicating that a malfunction has occurred or that a malfunction may occur in different ways. As a result, at least the user of the thermal printer 2 can differentiate the defect states of the thermal head 251.

Second Reporting Process

In the second reporting process, the evaluator 203 reports the evaluation result to the POS terminal 3. When the evaluator 203 makes the decision of step SA7, step SA11, step SA14, or step SA17, the evaluator 203 sends information indicating that the defect state of the thermal head 251 is that a defect has occurred to the POS terminal 3 by means of the printer communicator 22. When this information is received, the POS terminal controller 30 of the POS terminal 3 displays information indicating the same on the touch panel. When the evaluator 203 makes the decision of step SA5, step SA20, step SA23, or step SA26, the evaluator 203 sends information indicating that the defect state of the thermal head 251 is that a defect may occur to the POS terminal 3 by means of the printer communicator 22. When this information is received, the POS terminal controller 30 of the POS terminal 3 displays information indicating the same on the touch panel. By the POS terminal 3 displaying information on the touch panel, the effect of this process is the same as the first reporting process.

Note that in the first reporting process and the second reporting process, the method of reporting may differ according to the information being reported.

In the second reporting process, when sending information indicating the evaluation result made by referencing the resistance evaluation table 211, the evaluator 203 may include information indicating the location on the thermal head 251 of the heat elements 252 determined to be at the first defect level or second defect level. The evaluator 203 may also send information indicating the number of heat elements 252 determined to be at the first defect level or second defect level. By reporting information indicating the position and information indicating the number of heat elements 252 in addition to the information indicating the defect state of the thermal head 251, the POS terminal controller 30 can report the defect state of the thermal head 251 to the user in greater detail.

The operation of the thermal printer 2 described above describes a configuration that measures the resistance of all heat elements 252 of the thermal head 251, acquires a defect level based on the measured resistance and the consecutively adjacent count, and evaluates the defect state of the thermal head 251 according to the acquired defect level. However, if operation of the thermal printer 2 is based on the heat element 252 resistance and a resistance evaluation table 211, operation is not limited to the foregoing. For example, a configuration that references the resistance evaluation table 211 while measuring the resistance of the heat elements 252 of the thermal head 251 to evaluate the defect state of the thermal head 251 is conceivable. This configuration enables evaluation without energizing all heat elements 252, and can be expected to reduce power consumption during evaluation of the defect state of the thermal head 251. The first defect level and second defect level may also be further differentiated according to the consecutively adjacent count, and the evaluator 203 may assign a more granular defect level to all heat elements 252 based on the measured resistance, and evaluate the defect state of the thermal head 251 based on the continuity of the assigned defect levels.

The operation of the thermal printer 2 described above describes referencing the conveyance distance evaluation table 212 to evaluate the defect state of the thermal head 251, and then referencing the resistance evaluation table 211 to evaluate the defect state of the thermal head 251. However, the operation of the thermal printer 2 is not limited to the foregoing, and the evaluation processes may execute according to different flow charts at different times according to the evaluation.

As described above, a thermal printer 2 according to this embodiment has a thermal head 251 with multiple heat elements 252 (heat elements) for printing on roll paper (print media); a measurer 201 that measures the resistance of the heat elements 252; printer storage 21 (storage, memory) that stores a resistance evaluation table 211 (relational information) that relates heat element 252 resistance to a heat element 252 defect level defined based on a specific range of reflectivity (print density) of a symbol image; and an evaluator 203 (controller, processor) that references a resistance evaluation table 211 stored in the printer storage 21 to acquire a defect level based on resistance measured by the measurer 201, and evaluates the defect state of the thermal head 251 based on the defect level of heat elements 252 of a consecutively adjacent count (specific adjacent number).

This configuration evaluates the defect state of the thermal head 251 based on the defect level of the heat elements 252 of the consecutively adjacent count determined with reference to resistance evaluation table 211, and can therefore reflect the print quality of a symbol image to appropriately evaluate the defect state of the thermal head 251. Because the print quality of a symbol image is reflected to appropriately evaluate the defect state (life) of the thermal head 251, the user can know, by the thermal printer 2 executing the reporting process, the defect state of the thermal head 251 reflecting the print quality of a symbol image.

As a result, the user can, at the appropriate time, replace the thermal head 251 before problems occur, for example. In addition, the probability of operation stopping due to a thermal head 251 defect while the thermal printer 2 is printing is reduced. Business operations using the thermal printer 2 are also not interrupted, improving user convenience. Furthermore, because the probability of printing symbol images with low print quality is reduced, giving receipts printed with symbol images that cannot be read to customers can also be suppressed.

The resistance evaluation table 211 includes as defect level a first defect level corresponding to a first defect level resistance (first resistance), and a second defect level corresponding to a second defect level resistance (second resistance) that is higher than the first defect level resistance. If the resistance the measurer 201 measures is greater than or equal to a first defect level resistance and less than a second defect level resistance, the printer controller 20 references the resistance evaluation table 211, acquires a first defect level, and determines the defect state of the thermal head 251 is a state in which a defect (malfunction) may occur. If the resistance the measurer 201 measures is greater than or equal to a second defect level resistance, the printer controller 20 references the resistance evaluation table 211 and acquires the second defect level, and then determines the defect state of the thermal head 251 is a state in which a defect (malfunction) has occurred.

This configuration acquires the first defect level and determines the defect state of the thermal head 251 is that a defect (malfunction) may occur, or acquires a second defect level and determines that the defect state of the thermal head 251 is that a defect has occurred, can therefore evaluate the defect state of the thermal head 251 in stages, and can more appropriately evaluate the defect state of the thermal head 251.

The printer controller 20 evaluates the defect state of the thermal head 251 based on an resistance evaluation table 211 in which the range of a defect level varies according to the consecutively adjacent count.

By evaluating the defect state of the thermal head 251 based on an resistance evaluation table 211 in which the range of a defect level varies according to the consecutively adjacent count, this configuration can appropriately determine the defect state of the thermal head 251 to reflect the relationship between the consecutively adjacent count and the print quality of a symbol image.

The consecutively adjacent count in the resistance evaluation table 211 is determined based on the density of heat elements in the thermal head 251 and the density of a symbol image.

This configuration can therefore determine the consecutively adjacent count that determines the print quality of a symbol image, and can more appropriately evaluate the defect state of the thermal head 251.

The thermal printer 2 also has a data acquirer 202 for acquiring the total conveyance distance (conveyance distance) of the roll paper. The printer storage 21 stores total conveyance distance information (distance information) indicating the total conveyance distance of the roll paper at which the defect level changes. The printer controller 20 references the total conveyance distance information to acquire a defect level based on the roll paper conveyance distance the data acquirer 202 acquired, and based on the acquired defect level evaluates the defect state of the thermal head 251.

This configuration acquires a defect level based on the acquired roll paper conveyance distance, and based on the acquired defect level evaluates the defect state of the thermal head 251. As a result, the roll paper conveyance distance can be included in the evaluation, and the defect state of the thermal head 251 can be appropriately evaluated.

Second Embodiment

A second embodiment of the invention is described next.

Figure 6:
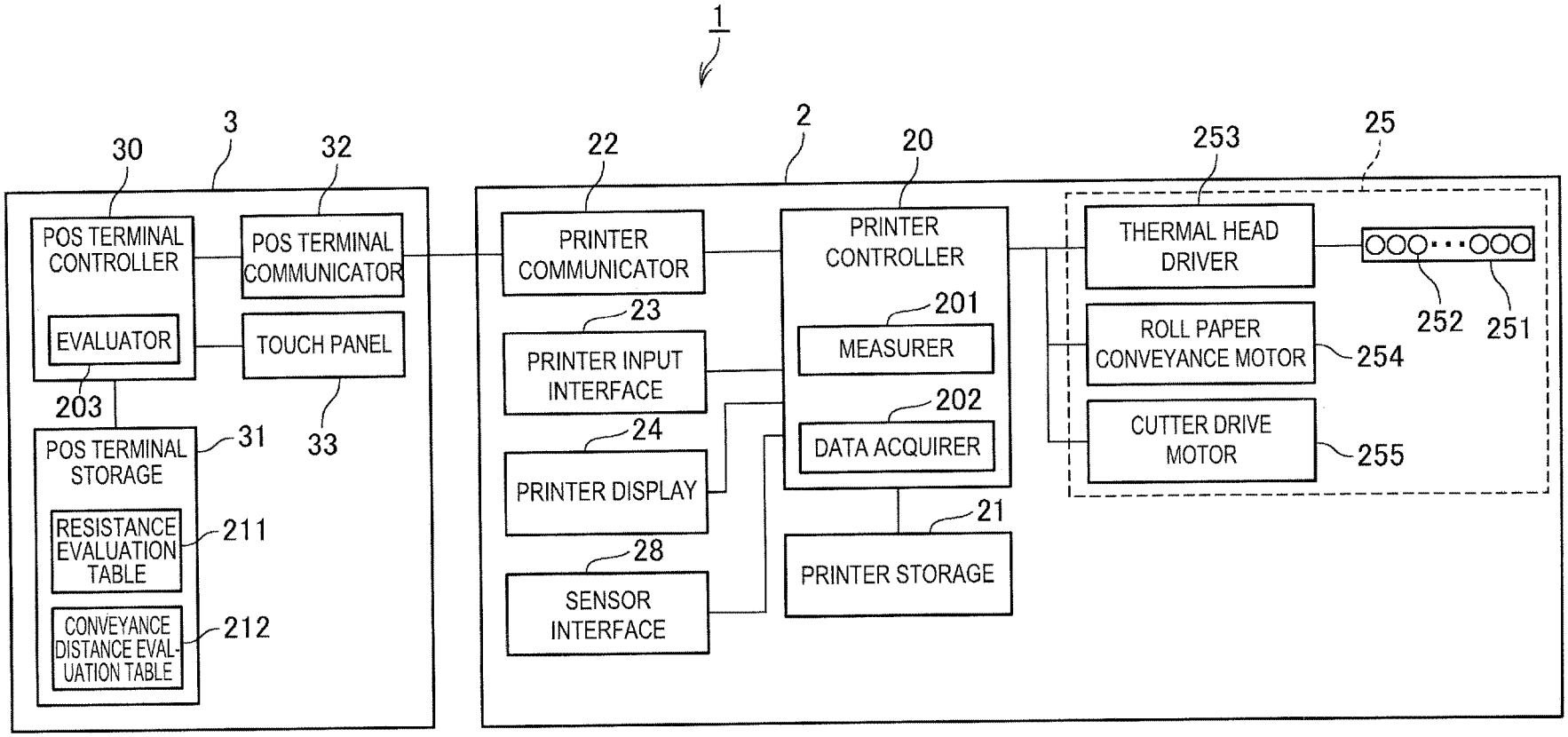
FIG. 6 is a block diagram of the configuration of a POS system according to the second embodiment of the invention.

FIG. 6 is a block diagram of the configuration of a POS system 1 according to the second embodiment of the invention.

Like parts in FIG. 6 and the POS system 1 shown in FIG. 1 are identified by like reference numerals, and further description thereof is omitted.

As will be understood by comparing FIG. 6 and FIG. 1, in a POS system 1 according to the second embodiment of the invention, the POS terminal controller 30 of the POS terminal 3 includes the evaluator 203 as a function block, and the POS terminal storage 31 stores the resistance evaluation table 211 and conveyance distance evaluation table 212.

Figure 7:
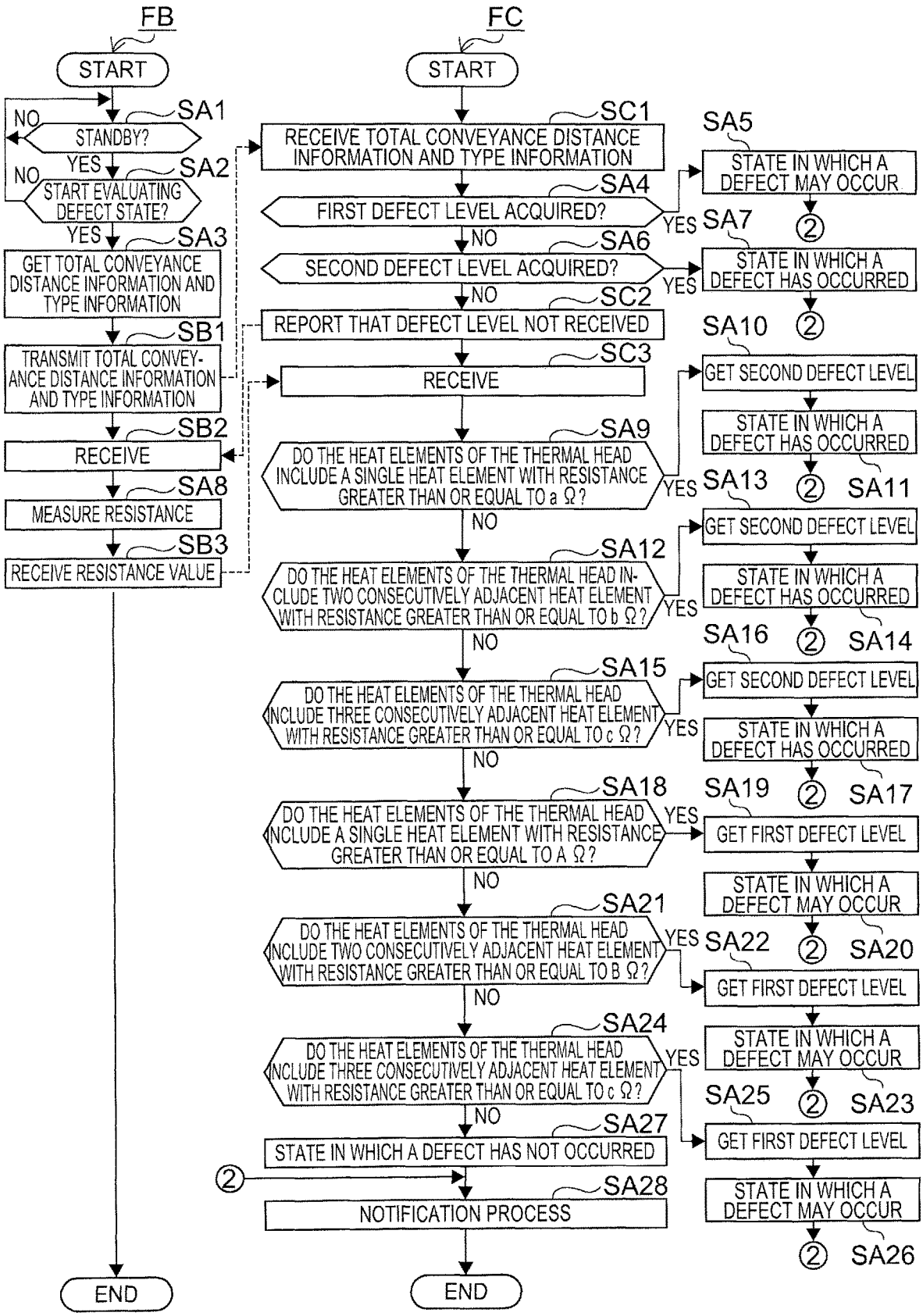
FIG. 7 is a flow chart of thermal printer and POS terminal operation.

FIG. 7 is a flow chart of the operation of the thermal printer 2 and POS terminal 3 according to the second embodiment of the invention. In FIG. 7, flow chart FB shows the operation of the thermal printer 2, and flow chart FC shows the operation of the POS terminal 3.

Steps in flow chart FB and flow chart FC in FIG. 7 that are the same as steps in flow chart FA in FIG. 5 are identified by like reference numerals, and further description thereof is omitted. Note that while the same reference numerals are assigned to, and further description of, identical steps in these flow charts and flow chart FA in FIG. 5 is omitted, the thermal printer 2 is the main device that executes the steps in flow chart FB, and the POS terminal 3 is the main device that executes the steps in flow chart FC.

As shown in flow chart FB in FIG. 7, the printer controller 20 of the thermal printer 2 sends the total conveyance distance information and type information acquired in step SA3 by the printer communicator 22 to the POS terminal 3 (step SB1).

As shown in flow chart FC in FIG. 7, the POS terminal controller 30 of the POS terminal 3 receives the total conveyance distance information and type information through the POS terminal communicator 32 (step SC1). When the total conveyance distance information and type information are received, the evaluator 203 of the POS terminal controller 30 executes step SA4 to step SA7.

If the second defect level is not acquired as the defect level of the heat elements 252 (step SA6: NO), the evaluator 203 of the POS terminal controller 30 sends by the POS terminal communicator 32 to the thermal printer 2 information indicating that the defect level of the heat elements 252 was not acquired by referencing the conveyance distance evaluation table 212 (step SC2).

As shown in flow chart FB in FIG. 7, the printer controller 20 of the thermal printer 2 then receives through the printer communicator 22 information indicating that the defect level of the heat elements 252 was not acquired (step SB2).

As shown in flow chart FB in FIG. 7, when the measurer 201 of the printer controller 20 of the thermal printer 2 measures the heat element 252 resistance, the measurer 201 sends the measured resistance by the printer communicator 22 to the POS terminal 3 (step SB3).

As shown in flow chart FC in FIG. 7, the POS terminal controller 30 of the POS terminal 3 then receives by the POS terminal communicator 32 the resistance the measurer 201 measured (step SC3). When the resistance measured by the measurer 201 is received, the evaluator 203 of the POS terminal controller 30 executes the process of step SA9 to step SA28. The second notification process described above is executed in the process of step SA28.

The POS terminal 3 evaluates the defect state of the thermal head 251 in this way in the second embodiment of the invention. This configuration has the same effect as the first embodiment.

As described above, a POS system 1 (printing system) according to the second embodiment of the invention includes a thermal printer 2 and a POS terminal 3 (information processing device) that can communicate with the thermal printer 2.

The thermal printer 2 includes a thermal head 251, a measurer 201, a printer communicator 22 (first communicator), and a printer controller 20 (first controller) that sends the resistance the measurer 201 measured by the printer communicator 22 to the POS terminal 3.

The POS terminal 3 has a POS terminal communicator 32 (second communicator) that communicates with the thermal printer 2; POS terminal storage 31 (processing device storage) that stores a resistance evaluation table 211; and a POS terminal controller 30 (second controller) that references the resistance evaluation table 211 the POS terminal storage 31 stores, acquires a defect level based on the resistance the POS terminal communicator 32 received, and evaluates the defect state of the thermal head 251.

By referencing a resistance evaluation table 211 and evaluating the defect state of the thermal head 251 based on the defect level of the heat elements 252 of a consecutively adjacent count, this configuration can reflect the print quality of a symbol image to appropriately evaluate the defect state of the thermal head 251.

A third embodiment of the invention is described next.

Figure 8:
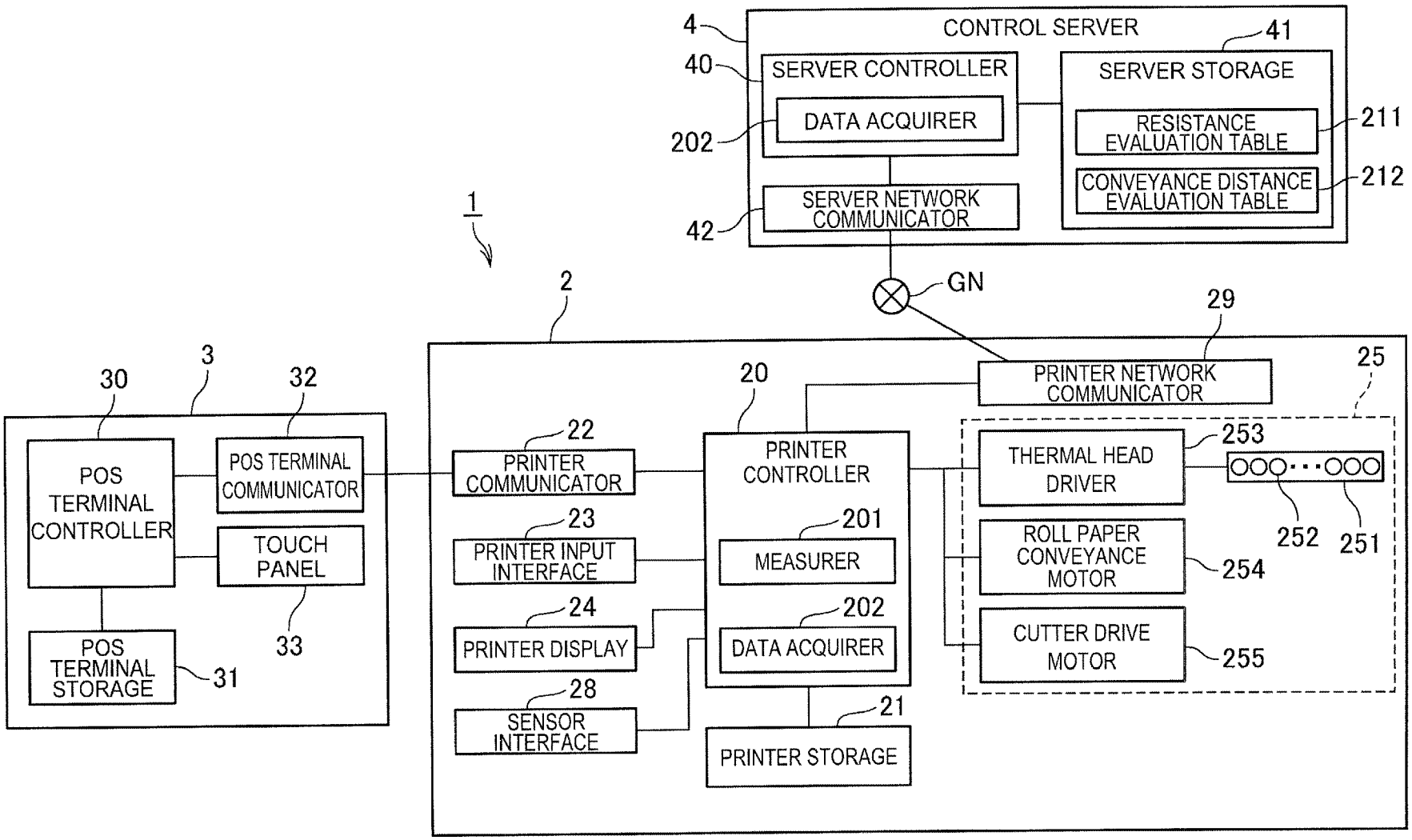
FIG. 8 is a block diagram of the configuration of a POS system according to the third embodiment of the invention.

FIG. 8 is a block diagram of a POS system according to the third embodiment of the invention.

Like parts in FIG. 8 and the POS system 1 shown in FIG. 1 are identified by like reference numerals, and further description thereof is omitted.

As will be understood by comparing FIG. 8 and FIG. 1, the POS system 1 according to the third embodiment of the invention also has a control server 4 (information processing device). The thermal printer 2 has a printer network communicator 29 (first communicator) that connects to a local area network and a global network GN including a communication network such as the Internet or a telephone network, and communicates with devices connected to the global network GN according to a specific communication protocol.

The control server 4 is a server that can communicate with the thermal printer 2. In other words, the control server 4 executes specific operations triggered by a request from a client. The control server 4 also sends data resulting from the operation to the client as necessary. For example, the control server 4 in this example functions as a management server that monitors the thermal printer 2 and manages the operating state of the thermal printer 2.

As shown in FIG. 8, the control server 4 includes a server controller 40 (second controller), server storage 41 (processing device storage), and server network communicator 42 (second communicator).

The server controller 40 includes a includes a CPU (processor), RAM, ROM, and other peripheral circuits not shown, and controls other parts of the control server 4.

The server controller 40 executes processes by the cooperation of hardware and software, such as a CPU reading and running firmware or programs stored in server storage 41, executing processes by functions embedded in an ASIC, or executing processes by signal processing by a signal processing circuit. A function block of the server controller 40 is the evaluator 203.

The server storage 41 is embodied by a hard disk drive, EEPROM, or other nonvolatile memory, and stores data rewritably. The server storage 41 also stores the resistance evaluation table 211 and conveyance distance evaluation table 212.

The server network communicator 42 communicates as controlled by the server controller 40 with devices (including the thermal printer 2) connected to the global network GN according to a specific communication protocol.

The control server 4 in the third embodiment of the invention executes the operation shown in FIG. 7 instead of the POS terminal 3 in the second embodiment. More specifically, the server controller 40 receives from the thermal printer 2 through the server network communicator 42 the heat element 252 resistance values measured by the measurer 201 of the thermal printer 2. The evaluator 203 of the server controller 40 references the resistance evaluation table 211 to evaluate the defect state of the thermal head 251. Evaluating by referencing the conveyance distance evaluation table 212 is also the same as the operation described in FIG. 7. As a result, the configuration of the third embodiment achieves the same effect as the effects of the first embodiment and second embodiment.

The invention is described above with reference to a preferred embodiment thereof, but the invention is not limited thereto and can be modified and adapted in many ways without departing from the scope of the accompanying claims.

For example, the resistance values stored in the resistance evaluation table 211 are for example only, and are not limited to the resistance values shown in FIG. 2. In addition, the total conveyance distances indicated by the total conveyance distance information stored in the conveyance distance evaluation table 212 are for example only, and the total conveyance distances are not limited to those shown in FIG. 3.

In addition, thermal printer 2 is described above as an example of a thermal printer, but the type of thermal printer is not limited and may be any printer having a thermal head 251.

The invention may also be conceived as a program for implementing the control method of the thermal printer 2 described above, a recording medium storing the program readably by a computer, or a transmission medium for transmitting the program. The recording medium may also be a magnetic or optical recording medium, or a semiconductor memory device, for example. More specifically, the recording medium may be a floppy disk, HDD (Hard Disk Drive), CD-ROM (Compact Disk Read Only Memory), DVD (Digital Versatile Disk), Blu-ray® Disc, magneto-optical disc, flash memory device, card media, or other type of removable or fixed recording medium. The thermal printer 2 may also be configured so that the printer controller 20 reads the program recorded on the recording medium into RAM, and runs the program from RAM. The recording medium may also be a nonvolatile memory device such as a hard disk drive, ROM (read-only memory), or other internal storage device of the thermal printer 2.

The function blocks described with reference to FIG. 1, FIG. 6, and FIG. 8 are grouped according to the main content of the processes of the functional configurations of the devices to facilitate understanding the invention. The configuration of the devices may be divided into further elements according to the process content. A single functional element may also be configured to execute more processes. The processes of the component elements may also be executed by a single hardware component, or by multiple hardware components. Yet further, the processes of the component elements may be embodied by a single program, or by multiple programs.

The process units of the flow charts shown in FIG. 5 and FIG. 7 are divided according to the main content of the processes in order to facilitate understanding the processes of individual devices. The invention is not limited by the method of segmenting or naming the processing units. The processes of the thermal printer 2 and POS terminal 3 can be further divided, according to the process content, into more processing units. Alternatively, single processing units may be further divided into more processing units. Yet further, if the equivalent process can be executed, the order of the processes (steps) in the accompanying flow charts is also not limited to that shown in the figures.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A thermal printer comprising:

a thermal head configured with multiple heat elements to print a symbol image on a print medium;

a measurer configured to measure heat element resistance;

memory configured to store relational information relating heat element resistance to defect level of a heat element defined based on a specific range of reflectivity in the symbol image printed on the print medium; and a processor configured to reference the relational information stored in the memory, acquire the defect level based on the resistance measured by the measurer, and evaluate a defect state of the thermal head based on the defect level of a specific adjacent number of heat elements, wherein the specific adjacent number of heat elements in the relational information is determined based on a density of the heat elements in the thermal head, and a density of the symbol image.

2. The thermal printer described in claim 1, wherein:

the relational information includes, as the defect level, a first defect level corresponding to a first resistance, and a second resistance that is greater than the first resistance; and the processor, when the resistance measured by the measurer is greater than or equal to the first resistance and less than the second resistance, references the relational information, acquires the first defect level, and determines the defect state of the thermal head is a state in which a defect may occur, and when the resistance measured by the measurer is greater than or equal to the second resistance, references the relational information, acquires the second defect level, and determines the defect state of the thermal head is a state in which a defect has occurred.

3. The thermal printer described in claim 1, wherein:

the processor evaluates the defect state of the thermal head based on relational information in which a range of the defect level differs according to the specific adjacent number.

4. The thermal printer described in claim 1, wherein:

the memory stores distance information indicating the conveyance distance of the print medium at which the defect level changes; and the processor acquires the print medium conveyance distance, references the distance information, acquires the defect level based on the conveyance distance of the print medium, and evaluates the defect state of the thermal head based on the acquired defect level.

5. A control method of a thermal printer having a thermal head configured with multiple heat elements to print a symbol image on a print medium, and a measurer configured to measure heat element resistance, the control method comprising:

storing relational information relating heat element resistance to defect level of a heat element defined based on a specific range of reflectivity in the symbol image printed on the print medium; and referencing the stored relational information, acquiring the defect level based on the resistance measured by the measurer, and evaluating a defect state of the thermal head based on the defect level of a specific adjacent number of heat elements, wherein the specific adjacent number of heat elements is determined based on a density of the heat elements in the thermal head, and a density of the symbol image.

6. The thermal printer control method described in claim 5, wherein:

the relational information includes, as the defect level, a first defect level corresponding to a first resistance, and a second resistance that is greater than the first resistance; and when the resistance measured by the measurer is greater than or equal to the first resistance and less than the second resistance, referencing the relational information, acquiring the first defect level, and determining the defect state of the thermal head is a state in which a defect may occur, and when the resistance measured by the measurer is greater than or equal to the second resistance, referencing the relational information, acquiring the second defect level, and determining the defect state of the thermal head is a state in which a defect has occurred.

7. The thermal printer control method described in claim 5, further comprising:

evaluating the defect state of the thermal head based on relational information in which a range of the defect level differs according to the specific adjacent number.

8. The thermal printer control method described in claim 5, further comprising:

acquiring a conveyance distance of the print medium;

storing distance information indicating the conveyance distance of the print medium at which the defect level changes; and referencing the distance information, acquiring the defect level based on the acquired print medium conveyance distance, and evaluating the defect state of the thermal head based on the acquired defect level.

9. A printing system comprising:

a thermal printer; and an information processing device capable of communicating with the thermal printer;

the thermal printer including a thermal head having multiple heat elements to print a symbol image on a print medium;

a measurer configured to measure heat element resistance;

a first communicator configured to communicate with the information processing device; and a first processor configured to cause the first communicator to send the resistance measured by the measurer to the information processing device; and the information processing device including a second communicator configured to communicate with the thermal printer;

memory configured to store relational information relating heat element resistance to defect level of a heat element defined based on a specific range of reflectivity in the symbol image printed on the print medium; and a second processor configured to reference the relational information stored in the memory, acquire the defect level based on the resistance received by the second communicator, and evaluate a defect state of the thermal head based on the defect level of a specific adjacent number of heat elements.

* * * * *